US006883743B2

(12) United States Patent
Schellekens

(10) Patent No.: US 6,883,743 B2
(45) Date of Patent: Apr. 26, 2005

(54) REEL SUSPENSION FOR HIGH-PRESSURE HOSE FOR CLEANING PIPES

(75) Inventor: Adrianus Cornelis Schellekens, Goirle (NL)

(73) Assignee: Rior B.V./Rioned (NL)

( * ) Notice: Subject to any disclaimer, the term of this patent is extended or adjusted under 35 U.S.C. 154(b) by 0 days.

(21) Appl. No.: 10/097,366

(22) Filed: Mar. 14, 2002

(65) Prior Publication Data

US 2002/0130210 A1 Sep. 19, 2002

(30) Foreign Application Priority Data

Mar. 15, 2001 (NL) ..... 1017606

(51) Int. Cl.[7] ..... B65H 75/18
(52) U.S. Cl. ..... 242/399; 242/399.2; 242/397.2
(58) Field of Search ..... 242/399, 399.2, 242/397.2, 397.4, 404.3, 130.2

(56) References Cited

U.S. PATENT DOCUMENTS 611,767 A * 10/1898 Bossow ..... 242/399.2
1,043,647 A * 11/1912 Wagner ..... 239/196
2,605,976 A * 8/1952 Henggeler ..... 242/390.7
3,107,877 A * 10/1963 Weaklend ..... 242/390.7
3,687,385 A * 8/1972 Skalleberg ..... 242/470
4,137,939 A * 2/1979 Chow ..... 137/355.27
4,454,999 A * 6/1984 Woodruff ..... 242/388.7
4,540,017 A * 9/1985 Prange ..... 137/355.12
D297,302 S * 8/1988 Nelson ..... D8/359
4,896,686 A * 1/1990 Schmidt et al. ..... 134/167 C
5,139,751 A * 8/1992 Mansfield et al. ..... 422/292
5,246,181 A * 9/1993 Straub et al. ..... 242/399.2
5,330,121 A * 7/1994 Eley ..... 242/401

* cited by examiner

*Primary Examiner*—Kathy Matecki
*Assistant Examiner*—Sang Kim
(74) *Attorney, Agent, or Firm*—McDermott Will & Emery LLP

(57) ABSTRACT

The present invention relates to a reel suspension for a high-pressure hose for mounting to a service vehicle. The reel suspension includes a first U-shaped frame having a reel shaft mounted thereto. The reel suspension further includes a second U-shaped frame hinged to said first U-shaped frame to form a jointed frame. In addition, the reel suspension has mounting means for making a hinged connection between the second U-shaped frame and the service vehicle, as well as means for securing the first U-shaped frame in a plurality of positions relative to said second U-shaped frame and for securing the second U-shaped frame in a plurality of positions relative to the service vehicle.

20 Claims, 5 Drawing Sheets

REEL SUSPENSION FOR HIGH-PRESSURE HOSE FOR CLEANING PIPES

FIELD OF THE INVENTION

The present invention relates to an improved arrangement for suspending high-pressure hoses on reels for cleaning drains, pipes, etc. Specifically, the present invention provides a pivotable reel suspension including a first U-shaped frame and a second U-shaped frame hinged together to form a jointed frame. The pivotable reel suspension can be folded into a service vehicle and covered to protect the joint frame when not in use.

BACKGROUND OF THE INVENTION

It is known in the art to provide reel suspensions for high-pressure rotating hoses on trailers. For example, The Sewer Equipment Company of America of 148 Depot Street, Glenview, Ill. 60025-2994 sells and leases a reel suspension for high-pressure rotating hoses known as model 747-4000R "Sniper Rotator Jet" ("The Sniper Rotator Jet"). The Sniper Rotator Jet is a trailer which is equipped with sewage cleaning equipment. The trailer includes a water tank, an engine with a pump, and a reel with high-pressure hose mounted on a projection at the back of the car. The high-pressure hose rotates around a vertical axle with a control panel fixed beside it. The reel suspension has a horizontal hollow shaft, which is suspended in a U-shaped frame, having vertical legs to support the axle at either end. The reel suspension for high-pressure hoses may be manually rotated around the vertical axle in order to aim the high-pressure hose's nozzle towards a drain or a pipe located in the ground or street on either side of the trailer. Similar trailers are known in the art, including the model 798 from Spartan Tool, L.L.C., of 1506 West Division Street, Mendota, Ill. 61342, which is constructed more or less the same as The Sniper Rotator Jet. A simpler model of the trailer is offered by O'Brian Manufacturing.

The elongated trailers described above have a number of drawbacks. Because the reel suspensions for high-pressure hoses are located at the back of the extended trailers, vehicles equipped with the trailers are adversely affected by the trailer's length. The length of the trailer makes it difficult to park the trailer in a street. Further, the reel suspensions for high-pressure hoses described above are connected in an "open air" configuration to increase the hose reel's area of use. The open air configuration creates problems when parking the trailer in a city. Therefore, providing a service vehicle having a reel suspension for high-pressure hoses in an enclosed arrangement is desirable.

SUMMARY OF THE INVENTION

The present invention relates to reel suspension devices for high-pressure hoses that can be mounted within a service vehicle. The hoses are hung on reels wherein the reel shaft is placed horizontally in a first U-shaped frame. The first U-shaped frame is preferably constructed with a middle leg to form an E-shaped frame and is placed in and hinged to a second U-shaped frame to form a jointed frame. The jointed frame is in turn pivotally mounted to a service vehicle by means of bars. The jointed frame can be bolted or secured to the service vehicle in a variety of interrelated positions while the reel suspension and high-pressure hoses are in use. One of the U-shaped frames includes a control box affixed thereto and the jointed frame is constructed of suitable construction materials such as structural steel or cast aluminum. The device can be positioned such that the high-pressure hose on the reel, and any accessories, can be exposed to the flow of hot air from the engine block when folded into the service vehicle.

The advantage of the present invention is that the reel with the high-pressure hose can be folded back, or folded into, a closed service vehicle such as a trailer or a delivery van. The reel with the high-pressure hose also can be folded out of the service vehicle and turned in a variety of directions for use. During the winter the rolled-up high-pressure hose on the reel can be protected against freezing by exposure to the hot engine air. One more advantage is that, after usage, the rolled-up high-pressure hose can drain dry outside the service vehicle before it is folded back into the service vehicle.

Furthermore, the first U-shaped frame, constructed as an E-shaped frame, has a nearly vertical back. The middle leg of the E-shaped frame is a hollow reel shaft for the supply to the high-pressure hose. The ends of the two outer legs of the E-shaped frame are linked vertically and hinged to the second U-shaped frame. The second U-shaped frame is linked vertically and hinged at the ends of the two legs to the ends of the legs of the first U-shaped frame. The back of the second U-shaped frame is positioned almost vertically. The ends of the back or the tops of the horizontally fixed legs are hinged to a horizontally protruding construction of bars of the service vehicle. The present invention provides a very suitably jointed reel frame that hinges outward from the service vehicle and which can easily be fixed in almost any position and which is very easy to work with and can moreover be produced very economically.

Further, a bar with a hinged eye at its end and a handle has been fixed to the lowest horizontal leg of the first U-shaped frame for smoothly leading and guiding the high-pressure hose into the drain and pipe for inner cleaning thereof.

The advantage is good conductance of the high-pressure hose from the reel into the drain or the sewer.

The advantages are that the first U-shaped frame and possibly the second U-shaped frame can be constructed more easily, and may in some cases be suitable for building into existing service vehicles.

In another embodiment, the first U-shaped frame can be made as a pure U-shaped frame, however the legs of the U-shaped frame are positioned vertically and the body of the first U-shaped frame is positioned horizontally. The reel and control box are mounted on the outside vertical leg of the first U-shaped frame. The legs of the second U-shaped frame are still positioned horizontally and the legs of the second U-shaped frame are linked with each other by means of a vertical bar as described above. The legs of the second U-shaped frame are hinged to a vertical inner leg of the first U-shaped frame. The reel suspension device can be fastened via the second U-shaped frame to the service vehicle in the same way as described above.

A preferred embodiment of the invention is explained in more detail below with respect to the figures.

DETAILED DESCRIPTION OF THE PREFERRED EMBODIMENTS

Figure 1:
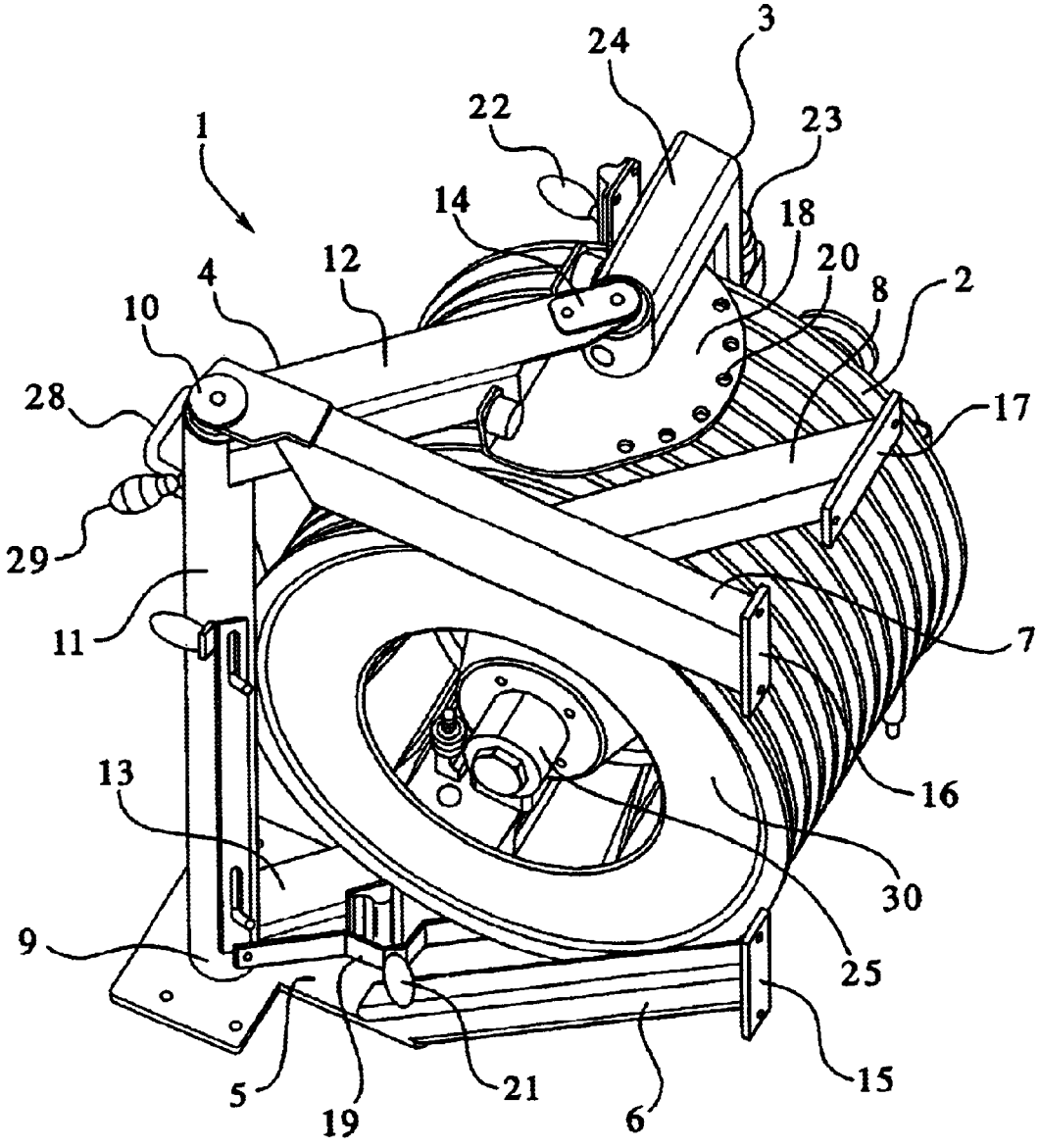
FIG. 1 is a perspective view of the reel suspension for high-pressure hoses, including a first and a second U-shaped frame forming a jointed frame, wherein both of the U-shaped frames are shown in their respective first positions.

A reel suspension device 1 for a high-pressure hose 2 is shown in FIG. 1. The reel suspension device 1 includes a first U-shaped frame 3 coupled to a second U-shaped frame 4 to form a jointed frame. The first U-shaped frame 3 includes a vertical member 23 and a pair of horizontal outside legs 24. Additionally, the first U-shaped frame 3 includes a horizontal hollow reel shaft 25 coupled to the vertical member 23 of the first U-shaped frame 3 between its horizontal legs 24 to form an E-shaped frame. The high-pressure hose 2 is wound on a reel 30 that is rotationally mounted on the reel shaft 25. A second U-shaped frame 4 has a vertical member 11 and a pair of horizontal outside legs 12 and 13. The horizontal legs 12 and 13 of the second U-shaped frame 4 are connected to the horizontal legs 24 of the first U-shaped frame 3 at a pair of hinge points 14 thereby forming a vertically rotating axis at their ends thereby coupling the first U-shaped frame 3 and the second U-shaped frame together to form the jointed frame. The second U-shaped frame 4 is attached to a mounting means, such as a fixed structural mounting support. The fixed structural mounting support shown in FIG. 1 includes a first plate 5 and a plurality of bars 6, 7 and 8, such that the second U-shaped frame 4 hinges vertically along a first pair of hinge points 9 and 10 to the mounting support. Each bar 6, 7 and 8 has a respective capping 15, 16 and 17 for mounting the reel suspension device 1 to another object, such as a service vehicle. In the preferred embodiment, the reel suspension device 1 can be fixed to a service vehicle (not shown), such as a trailer or a delivery van, by bolting the plate 5 and the cappings 15, 16 and 17 to a mounting portion of the service vehicle.

The jointed frame of the reel suspension device 1 may be positioned in a plurality of configurations such that the nozzle of the high-pressure hose 2 may be directed to extend from the reel suspension device 1 in a plurality of angles, as described herein. In FIG. 1, both the first U-shaped frame 3 and the second U-shaped frame 4 are shown in their first position. The reel suspension device 1 includes means for securing the first U-shaped frame 3 in a plurality of positions relative to the second U-shaped frame 4, as well as means for securing the second U-shaped frame 4 in a plurality of positions relative to the service vehicle. In FIG. 1, the securing means includes the first plate 5, located at the hinge 9 of the second U-shaped frame 4, and a second plate 18, located at the hinge 14 between the first U-shaped frame 3 and the second U-shaped frame 4. A plurality of holes 19 and 20 are drilled in plates 5 and 18 such that a first bolt pin (not shown) and a second bolt pin (not shown) may be used to secure the reel suspension in various positions. The first bolt pin may be used in the first plate 5 to secure the second U-shaped frame in a position relative to the fixed structural mounting support. The second bolt pin may be used in the second plate 18 to secure the first U-shaped frame 3 in a position relative to the second U-shaped frame 4. The position of the plates 5 and 18 can be adjusted by using a corresponding protruding knob 21 and 22.

Figure 2:
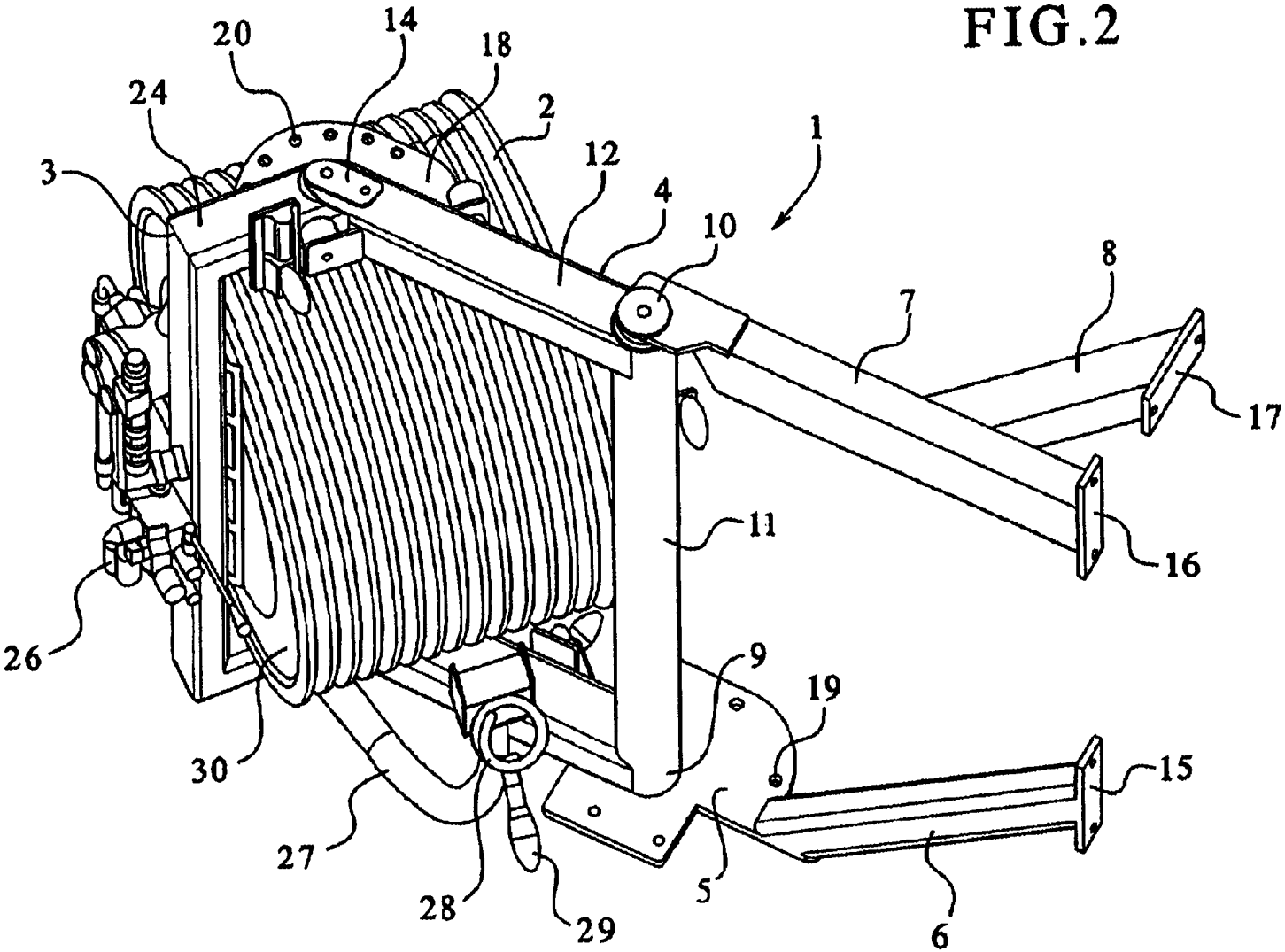
FIG. 2 is a perspective view of the reel suspension showing the first U-shaped frame in the first position and the second U-shaped frame in a second position.

As shown in FIG. 2, the second U-shaped frame 4 rotates around the first pair of hinge points 9 and 10 to a second position. As described above, the first bolt pin may be used in conjunction with the first plate 5 to secure the second U-shaped frame 4 in the second position. Moreover, the first bolt pin may be used in conjunction with the first plate 5 to secure the second U-shaped frame 4 in a plurality of intermediate positions between the first and the second positions. As additionally shown in FIG. 2, the reel suspension device 1 includes a control box 26 and means for steering the high pressure hose 2 along the inside of a drain or a pipe (not shown). In FIG. 2, the steering means includes a hinging bar 27 having a hinging eye 28 and a handle 29 for smoothly conducting and steering the high-pressure hose 2 along the inside of a drain or a pipe.

Figure 3:
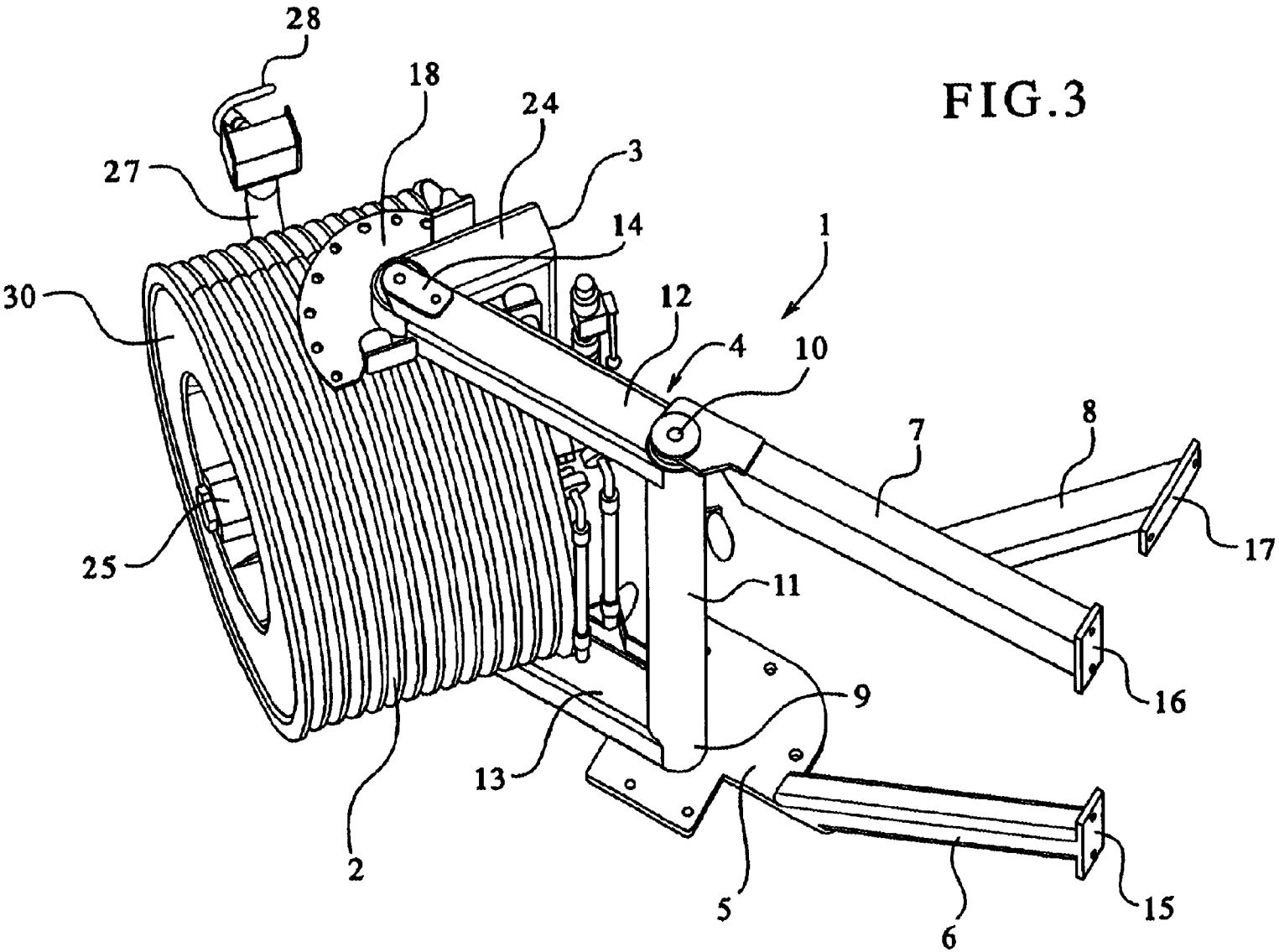
FIG. 3 is a perspective view of the reel suspension showing both U-shaped frames in their respective second positions.

As shown in FIG. 3, the first U-shaped frame 3 can rotate around the second pair of hinge points 14 to a second position. As described above, the second bolt pin may be used in conjunction with the second plate 18 to secure the first U-shaped frame 3 in the second position. Moreover, the second bolt pin may be used in conjunction with the second plate 18 to secure the first U-shaped frame 3 in a plurality of intermediate positions between the first and the second positions.

FIGS. 4A–4D illustrate a variety of configurations in which the reel suspension device 1 may be positioned. Arrows A, B and C indicate the direction the nozzle of the high-pressure hose 2 is pointing in each of the various positions.

Figure 4A:
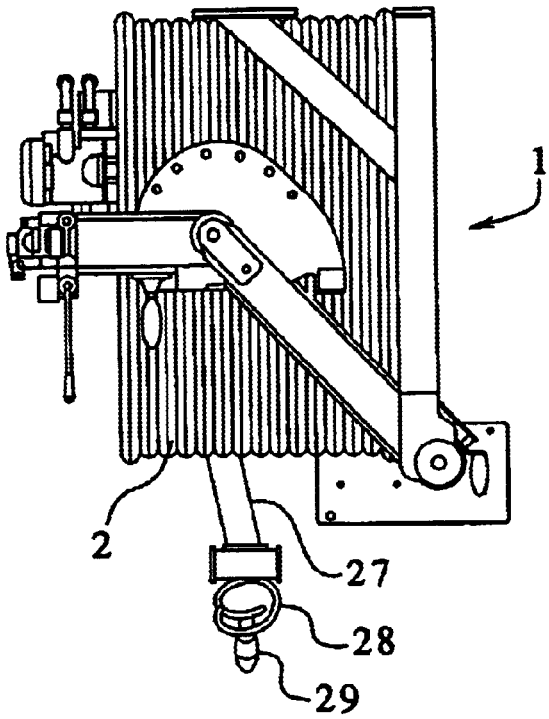
FIG. 4A is a top view of the reel suspension for high-pressure hoses showing both of the U-shaped frames in their respective first positions, with the nozzle of the high-pressure hose directed forward.

FIG. 4A shows the first U-shaped frame 3 and the second U-shaped frame 4 in their respective first positions. When the reel suspension device 1 is mounted to a service vehicle, the configuration shown in FIG. 4A may be used to fold the high-pressure hose back into the service vehicle.

Figure 4B:
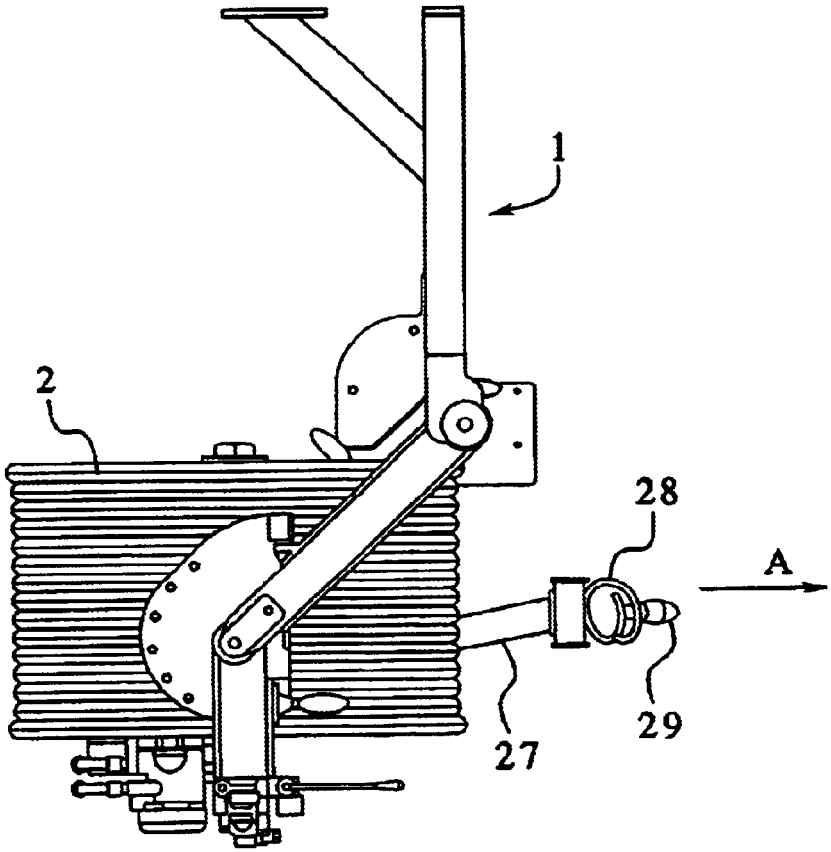
FIG. 4B is a top view of the reel suspension for high-pressure hoses showing the first U-shaped frame in the first position and the second U-shaped frame in the second position, with the nozzle of the high-pressure hose directed to the right.

FIG. 4B shows the first U-shaped frame 3 still in the first position but with the second U-shaped frame 4 in its second position. When the reel suspension device 1 is mounted to a service vehicle, the configuration shown in FIG. 4B may be used to extend the reel suspension device 1 from the service vehicle to direct the nozzle of the high-pressure hose 2 to the right.

Figure 4C:
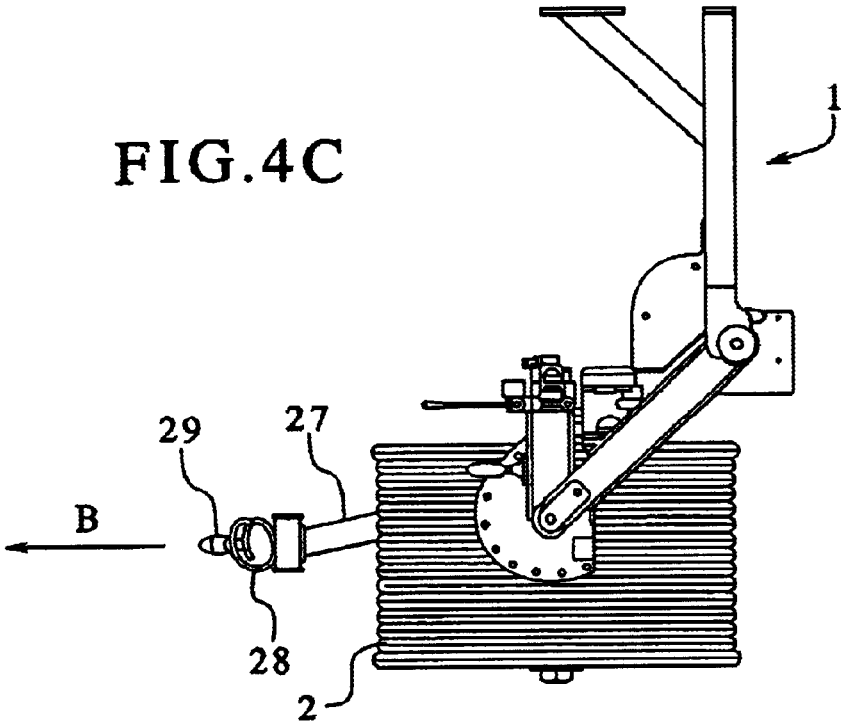
FIG. 4C is a top view of the reel suspension for high-pressure hoses showing both of the U-shaped frames in their respective second positions, with the nozzle of the high-pressure hose directed to the left.

FIG. 4C shows both of the U-shaped frames 3 and 4 in their respective second positions. When the reel suspension device 1 is mounted to a service vehicle, the configuration shown in FIG. 4C may be used to extend the reel suspension device 1 from the service vehicle to direct the nozzle of the high-pressure hose 2 to the left.

Figure 4D:
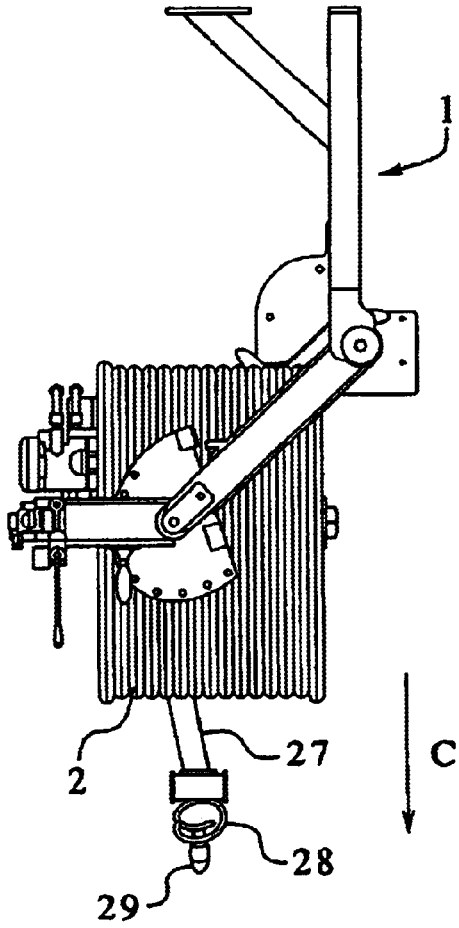
FIG. 4D is a top view of the reel suspension for high-pressure hoses showing the first U-shaped frame in an intermediate position and the second U-shaped frame in the second position, with the nozzle of the high-pressure hose directed forward.

FIG. 4D shows the first U-shaped frame 3 in its first position and the second U-shaped frame 4 in its second position. When the reel suspension device 1 is mounted to a service vehicle, the configuration shown in FIG. 4D may be used to extend the reel suspension device 1 from the service vehicle to direct the nozzle of the high-pressure hose 2 forward.

In another embodiment (not shown), the first U-shaped frame is made as a pure U-shaped frame, however the legs of the U-shaped frame are positioned vertically and the body of the first U-shaped frame is positioned horizontally. The reel and control box are mounted on an outside vertical leg of the first U-shaped frame. The legs of the second U-shaped frame are still positioned horizontally and the legs of the second U-shaped frame are linked with each other by means of a vertical bar as described above. The legs of the second U-shaped frame are hinged to an inner vertical leg of the first U-shaped frame. The reel suspension device can be fastened via the second U-shaped frame to the service vehicle in the same way as described above.

From the foregoing description, it will be apparent that the folding reel suspension device of the present invention has a number of advantages, some of which have been described above and others of which are inherent in the reel suspension device of the present invention. Also, it will be understood that modifications can be made to the present invention without departing from the teachings of the invention. Accordingly the scope of the invention is only to be limited as necessitated by the accompanying claims.

We claim:

1. A reel suspension device for a high pressure hose and reel comprising:

a mounting support; and a jointed frame comprising a first portion, including a reel shaft, and a second portion rotatably coupled to said first portion about a first axis of rotation, wherein said reel shaft rotates about said first axis of rotation in a generally circular path, further wherein said second portion is rotatably coupled to said mounting support about a second axis of rotation such that said second portion rotates about said second axis of rotation in a generally circular path and further wherein said second portion is a generally U-shaped frame.

2. The reel suspension device of claim 1 further comprising a means for steering the high pressure hose along the inside of a drain or a pipe.

3. The reel suspension of claim 1 further comprising a control panel mounted to said first portion.

4. The reel suspension of claim 3 wherein said control panel further comprises an elongated hinging bar.

5. The reel suspension of claim 1 further including means for securing said first portion in a plurality of positions relative to said second portion.

6. The reel suspension of claim 1 further including means for securing said second portion in a plurality of positions relative to said mounting support.

7. A reel suspension device for a high pressure hose and reel comprising:

a first generally U-shaped frame including a reel shaft;

a second U-shaped frame, wherein said first U-shaped frame and said second U-shaped frame are rotationally attached thereby forming a first generally vertical axis of rotation between said first U-shaped frame and said second U-shaped frame; and a mounting support wherein said mounting support is pivotally coupled to said second U-shaped frame thereby forming a second vertical axis of rotation, whereby said second U-shaped frame rotates in a circular path around said second axis of rotation.

8. The reel suspension device of claim 7 wherein said first U-shaped frame includes a generally vertical member attached to a pair of generally horizontal legs.

9. The reel suspension device of claim 7 wherein said reel shaft forms a portion of said first U-shaped frame.

10. The reel suspension device of claim 7 further comprising a means for steering the high pressure hose along the inside of a drain or a pipe.

11. The reel suspension of claim 7 further comprising a control panel mounted to said first U-shaped frame.

12. The reel suspension of claim 11 wherein said control panel further comprises an elongated hinging bar.

13. The reel suspension of claim 7 further including means for securing said first U-shaped frame in a plurality of positions relative to said second U-shaped frame.

14. The reel suspension of claim 7 further including means for securing said second U-shaped frame in a plurality of positions relative to said mounting support.

15. A reel suspension device for a high pressure hose and reel comprising:

a mounting support; and a jointed frame comprising a first portion, including a reel shaft, and a second portion rotatably coupled to said first portion about a first axis of rotation, wherein said reel shaft rotates about said first axis of rotation in a generally circular path, further wherein said second portion is rotatably coupled to said mounting support about a second axis of rotation such that said second portion rotates about said second axis of rotation in a generally circular path and further wherein said first portion is a generally U-shaped frame.

16. The reel suspension of claim 15 wherein said first portion includes a generally vertical member attached to a pair of generally horizontal legs.

17. The reel suspension of claim 15 further including means for securing said first portion in a plurality of positions relative to said second portion.

18. The reel suspension of claim 15 further including means for securing said second portion in a plurality of positions relative to said mounting support.

19. The reel suspension device of claim 15 further comprising a means for steering the high pressure hose along the inside of a drain or a pipe.

20. The reel suspension of claim 15 further comprising a control panel mounted to said first portion.

* * * * *